United States Patent [19]

Vestuti

[11] Patent Number: 5,003,724

[45] Date of Patent: Apr. 2, 1991

[54] TREE GRATE SYSTEM

[76] Inventor: Emile Vestuti, Apartado 80,896, Caracas, 1080-A, Venezuela

[21] Appl. No.: 366,682

[22] Filed: Jun. 15, 1989

[51] Int. Cl.[5] ..... A01G 17/00

[52] U.S. Cl. ..... 47/25; 47/32; 52/100

[58] Field of Search ..... 47/25, 32; 52/98, 100

[56] References Cited

U.S. PATENT DOCUMENTS

| | | | |
|---|---|---|---|
| 173,446 | 2/1875 | Cottman | 47/25 |
| D. 283,003 | 3/1986 | McKinley | 47/25 |
| 4,308,688 | 1/1982 | Revane | 47/25 |
| 4,648,203 | 3/1987 | Worzek | 47/32 |
| 4,858,378 | 8/1989 | Helmy | 47/25 |

FOREIGN PATENT DOCUMENTS

| | | | |
|---|---|---|---|
| 2317216 | 10/1974 | Fed. Rep. of Germany | 47/35 |
| 2517949 | 10/1976 | Fed. Rep. of Germany | 47/25 |
| 2920873 | 11/1980 | Fed. Rep. of Germany | 47/25 |
| 515545 | 4/1921 | France | 47/25 |
| 26775 | 3/1924 | France | 47/25 |
| 296501 | 5/1932 | Italy | 47/25 |
| 209931 | 1/1924 | United Kingdom | 52/100 |
| 2053640 | 2/1981 | United Kingdom | 47/25 |
| 2166031 | 4/1986 | United Kingdom | 47/25 |

*Primary Examiner*—Henry E. Raduazo

*Attorney, Agent, or Firm*—Bachman & LaPointe

[57] ABSTRACT

This invention consists of a tree grate system in concrete, artificial stone, terrazzo or similar molded material intended for use at ground level at the base of a tree. The system is designed to permit periodic enlargement of the opening for the tree trunk according to the growth of the tree. The system is formed by parallel or concentric grate elements forming a horizontal grill. Adjacent grate elements are joined by connectors which, when severed at their point of least section, permit the easy removal of the grate elements nearest the tree trunk, leaving a clean, presentable break at the remaining adjoining element.

17 Claims, 3 Drawing Sheets

TREE GRATE SYSTEM

BACKGROUND OF THE INVENTION

Tree grates are widely known and used in various forms at the base of trees, particularly in urban locations where trees are planted in openings in sidewalk or promenade pavements. A tree requires a certain unpaved area at its base through which it receives water and nutrients necessary to its growth. In intensively used areas it is impractical or undesirable to leave this opening as bare earth, or covered with decorative, low vegetation. Tree grates are used in such situations to cover these openings, thereby eliminating the necessity to plant and maintain grass, ground cover or shrubbery at the tree base. The tree grates also prevent the tree well from becoming a collector of trash.

The tree grates in widest use are manufactured of cast iron. These are available with openings of a fixed size around the tree trunk, or may be obtained with openings capable of being enlarged. In the latter case, various methods of enlargement may be used. The grate may be formed of concentric sections which are bolted together in the beginning, the inner ring(s) of which may be unbolted and removed as the tree grows. Another method allows removal of inner rings by breaking radial links with hammer and chisel, or by other means.

Tree grates are also manufactured in concrete. The concrete tree grates known to the inventor, however, lack any mechanism which permits successive enlargement of the opening of the tree trunk in such a way as to be easily achieved, and which results in a neat, presentable opening of larger size which does not manifest objectionable traces of the enlarging process.

Accordingly, it is an object of the present invention to provide an improved tree grate system.

It is a further object of the present invention to provide a tree grate system as above which easily permits successive enlargement of the opening for the tree trunk.

It is yet a further object of the present invention to provide a tree grate system as above which facilitates enlargement of the opening in a way which does not manifest objectionable traces of the enlarging process.

These and other objects and advantages will become clearer from the following description and drawings in which like reference numerals depict like elements.

SUMMARY OF THE INVENTION

The foregoing objects and advantages are achieved by the tree grate system of the present invention which is intended for use at the base of a tree. The system is designed to permit periodic enlargement of the opening for the tree trunk according to the growth of the tree. The system comprises a substantially planar grill having a desired geometric configuration formed by two or more panels which when positioned in an opening form rings of parallel or concentric grate elements. Adjacent grate elements are joined by one or more connectors which, when severed at their point of least section, permit the easy removal of the grate elements nearest the tree trunk, leaving a clean, presentable break at the remaining adjoining element. The grate elements and connectors may be formed from concrete, artificial stone, terrazzo or similar molded material.

DETAILED DESCRIPTION OF THE INVENTION

A previously discussed, in many urban locations, trees are planted in openings in sidewalk or promenade pavements. The tree grate system of the present invention is intended for use at ground level to cover these openings. This eliminates the need to plant and maintain grass, ground cover or shrubbery at the tree base and also prevents the tree well from becoming a collector of trash. The tree grate system of the present invention accomplishes this while leaving openings through which the tree can receive water and nutrients necessary to its growth.

Figure 1:
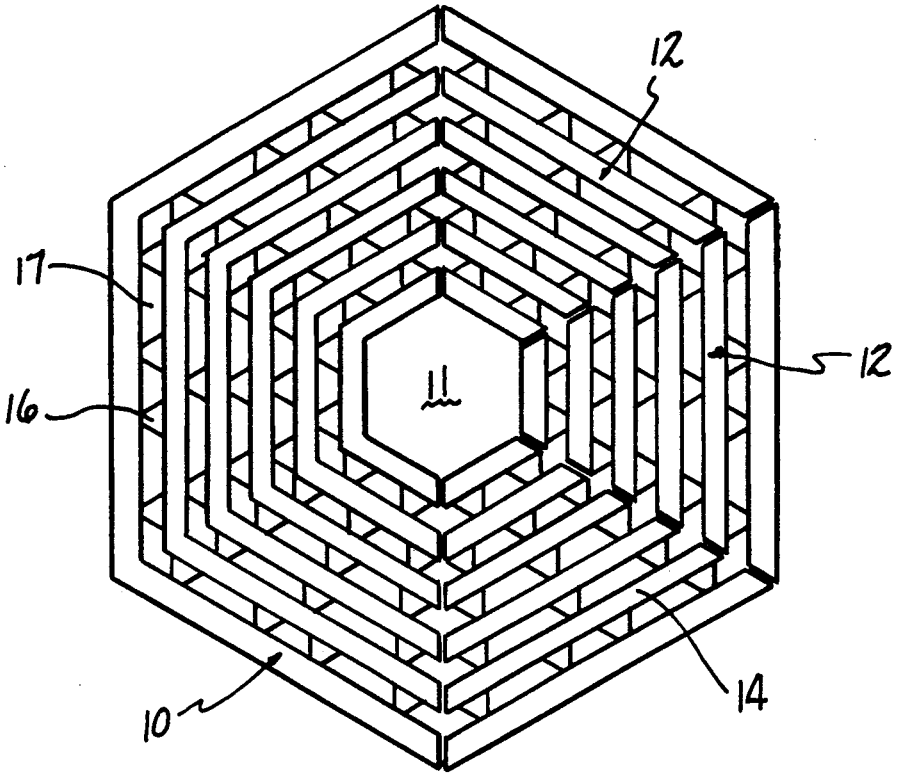
FIG. 1 is a plan view of a hexagonally shaped tree grate system in accordance with the present invention.
Figure 2:
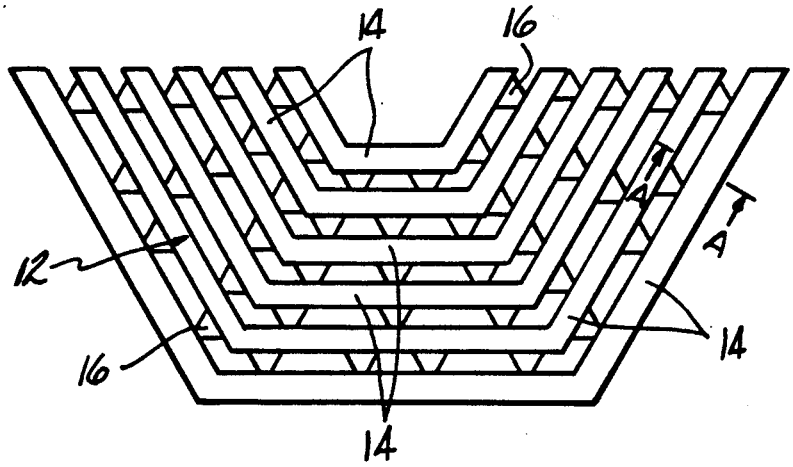
FIG. 2 is a plan view of a portion of the grate system of FIG. 1.
Figure 4:
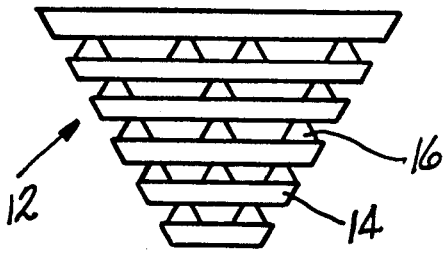
FIG. 4 is a plan view of one of the sectional grate elements in the system of FIG. 1.

FIG. 1 illustrates a hexagonally shaped tree grate system 10 in accordance with the present invention. The system comprises a substantially planar grill having a central opening 11 for the tree trunk formed by two or more grate panels 12 which together substantially fill the sidewalk or promenade opening not shown in which the tree is planted. Each panel 12 may have any desired shape or configuration. For example, the panel 12 may be shaped as shown in FIG. 2 so that two such panels form the hexagonally shaped system. Alternatively, the panels 12 may have a trapezoidal shape similar to that shown in FIG. 4 so that six such panels forms the hexagonally shaped system.

Each panel 12 is formed by a series of parallel or concentric grate elements 14 joined together by one or more connecting elements 16. The space 17 between adjacent grate elements 14 and adjacent connecting elements may be used to provide water and other nutrients to the tree. The connecting elements or connectors 16 act as links. They are designed to permit easy removal of the grate element nearest the tree trunk so as to enable enlargement of the opening for the tree trunk according to the growth of the tree.

Figure 3:
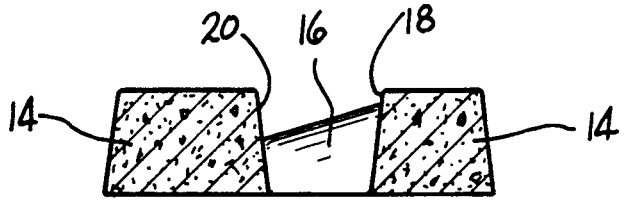
FIG. 3 is a sectional view of a portion of a grate element taken along lines A—A in FIG. 2.

As shown in FIG. 3, each connector 16 may have a trapezoidal shape. The connector 16 may taper both horizontally and vertically as one moves from the surface 18 of an inner grate element towards the surface 20 of an adjacent, outer grate element. Such a design results in a connector whose weakest plane is adjacent the surface 20 at its point of least section. It is at this plane that the connector 16 is severed when the opening for the tree trunk is enlarged, leaving a clean presentable break at the surface 20.

As shown in FIGS. 7(*a*)–7(*f*), the connector(s) 16 may have a variety of shapes. For example, the connector(s) 16 may be trapezoidal in plan while semicircular or triangular in a vertical section parallel to the grate elements 14. As used herein, the term "plan" means a plane which is not parallel to a vertical plane passing through an adjacent grate element 14. Alternatively, the connector(s) 16 may be trapezoidal both in plan and in said vertical section. Whatever shape is used for the connector(s), the primary consideration is that it be severable leaving a clean presentable break at the surface 20. It is also desirable from a manufacturing standpoint that the connector be readily attainable via a molding process.

The grate elements 14 and connectors 16 may be formed from any suitable moldable material. For example, they can be formed from concrete, artificial stone, terrazzo or similar molded material. If desired, the grate elements and/or connectors may be reinforced with steel rods or the like. The grate elements 14 and connectors 16 are cast or molded together in order to form a unitary or integral structure.

The tree grate system 10 as shown in FIG. 1 comprises a series of panels 12 defining an opening 11 for the tree not shown. The panels form a grill having two or more concentric or parallel rings of grate elements surrounding the tree trunk. The innermost ring defines the size of the opening 11.

When the opening 11 needs to be enlarged, the innermost ring is removed by severing the connectors between it and its adjacent ring. The connectors may be severed in any desired manner for example by means of a blow from a hammer and chisel, by cutting with an abrasive wheel, etc.

Figure 6:
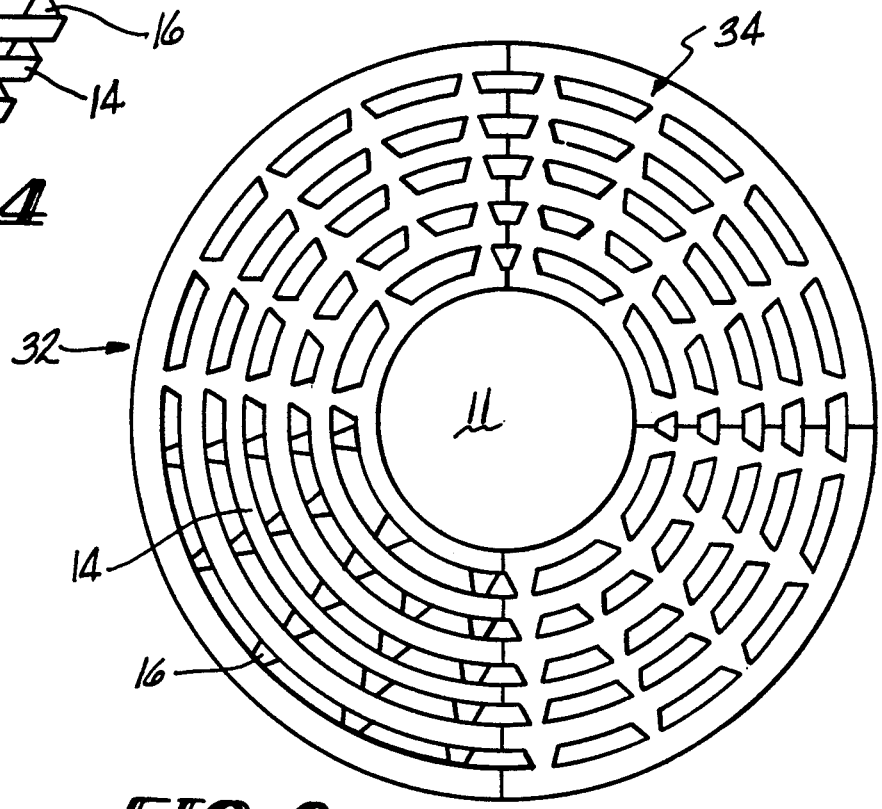
FIG. 6 is a plan view of a circular shaped tree grate system in accordance with the present invention.
Figure 5:
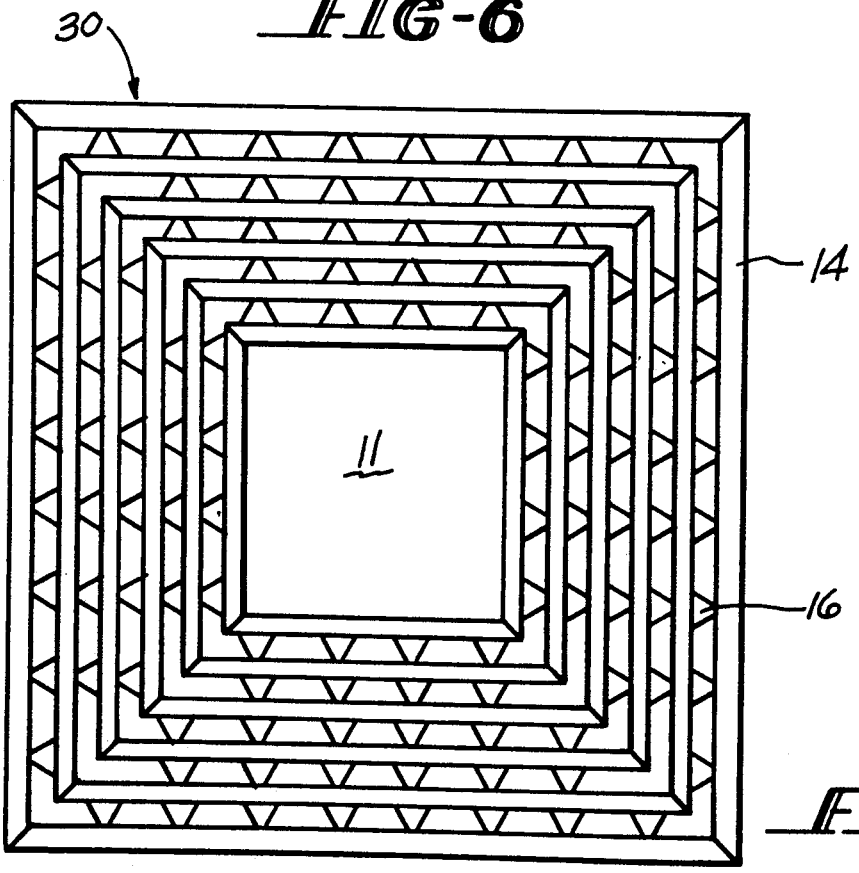
FIG. 5 is a plan view of a square shaped tree grate system in accordance with the present invention.
Figure 7A:
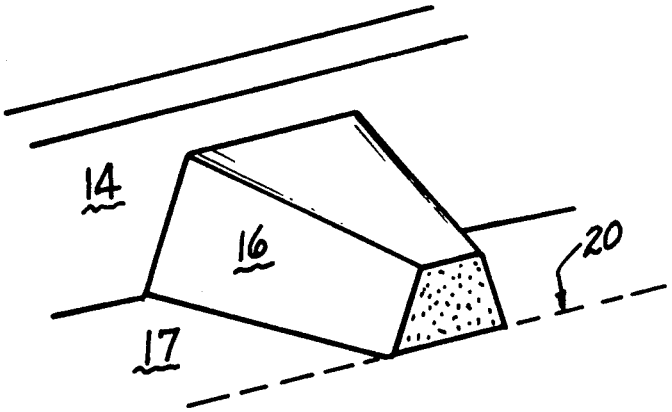
FIGS. 7(*a*)–7(*f*) illustrate alternative embodiments of the elements used to connect adjacent rings of the tree grate system.
Figure 7B:
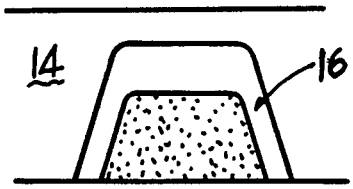
Figure 7C:
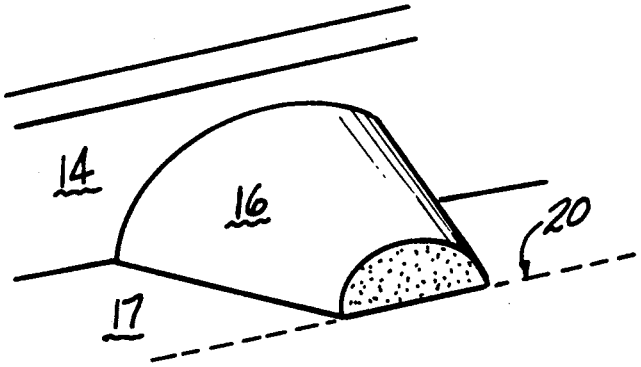
Figure 7D:
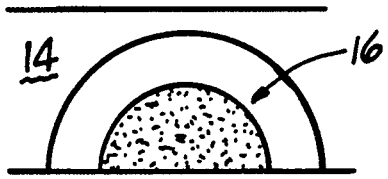
Figure 7E:
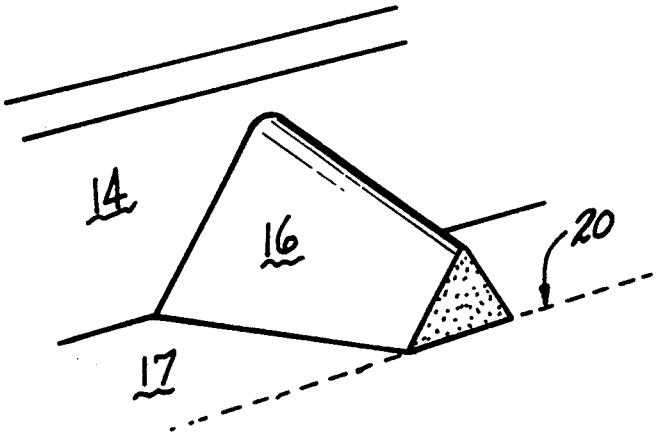
Figure 7F:
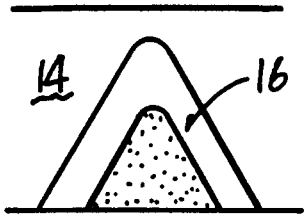

The grate system 10 of the present invention could have any desired geometric form: circular, square, oval, rectangular, hexagonal, octagon, etc. FIG. 5 illustrates a square shaped grate system having a square shaped opening formed by four trapezoidally shaped panels 30. FIG. 6 illustrates a circular grate system having a circular opening for the tree trunk. The circular grate system may be formed by four identical quarter panels 32 or twO semi-circular panels 34.

It is apparent that there has been provided in accordance with this invention a tree grate system which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A tree grate system for covering an opening while enabling water and other materials to be provided to a tree, said system comprising:

a substantially planar grill formed by at least two grate panels;

each said panel having an innermost grate element and at least one additional grate element outside of said innermost grate element and means for facilitating removal of a desired grate element in a clean, presentable manner in order to accommodate growth of a tree trunk;

said removal facilitating means comprising frangible means for providing a clean appearance adjacent each said additional grate element; and said grill formed by said panels having at least two rings of grate elements defining an opening for said tree trunk.

2. A system according to claim 1 wherein said frangible means comprises severable connecting elements joining adjacent ones of said grate elements.

3. A system according to claim 2 wherein each said connecting element is shaped so as to permit an easy and clean fracture at a face of an outer grate element.

4. A system according to claim 3 wherein each said connecting element is trapezoidally shaped.

5. A system according to claim 1 wherein said grill has a circular configuration with a circular opening for said tree trunk.

6. A system according to claim 5 wherein said grill is formed by four identically-shaped grate panels.

7. A system according to claim 1 wherein said grill has a hexagonal configuration with a hexagonally shaped opening for said tree trunk.

8. A system according to claim 7 wherein said grill is formed by a plurality of trapezoidally shaped panels.

9. A system according to claim 7 wherein said grill is formed by two identically shaped panels.

10. A system according to claim 1 wherein said grill has a four-sided polygonal configuration with a four-sided opening for said tree trunk.

11. A system according to claim 10 wherein said grill is formed by four trapezoidally shaped panels.

12. A system according to claim 1 wherein said grate elements and frangible means are formed from a molded material.

13. A system according to claim 1 wherein said grate elements and frangible means are formed from a material selected from the group consisting of concrete, artificial stone and terrazzo.

14. A system according to claim 1 wherein said grate elements and frangible means are formed from an internally reinforced material.

15. A system according to claim 1 wherein said rings of grate elements are concentric.

16. A system according to claim 1 wherein said rings of grate elements are parallel.

17. A tree grate system for covering an opening while enabling water and other materials to be provided to a tree, said system comprising:

a substantially planar grill formed by a least two grate elements;

each said panel having at least two grate elements formed together with means for facilitating removal of a desired grate element in a clean presentable manner in order to accommodate growth of a tree trunk;

said removal facilitating means comprising at least one connector which tapers from its point of connection to an inner grate element to its point of connection to an outer grate element and which when severed at its point of least section leaves a clean, presentable break at the outermost grate element; and said grill formed by said panels having at least two rings of grate elements defining an opening for said tree trunk.

* * * * *